US009415483B2

(12) United States Patent
Krause et al.

(10) Patent No.: US 9,415,483 B2
(45) Date of Patent: Aug. 16, 2016

(54) TUFTED BUFFING PAD

(75) Inventors: Aaron C. Krause, Voorhees, NJ (US); Aleksandrs Titovs, Olaine (LV)

(73) Assignee: 3M INNOVATIVE PROPERTIES COMPANY, Saint Paul, MN (US)

( * ) Notice: Subject to any disclaimer, the term of this patent is extended or adjusted under 35 U.S.C. 154(b) by 517 days.

(21) Appl. No.: 13/319,707

(22) PCT Filed: May 13, 2010

(86) PCT No.: PCT/US2010/034627

§ 371 (c)(1), (2), (4) Date: Nov. 10, 2011

(87) PCT Pub. No.: WO2010/132621

PCT Pub. Date: Nov. 18, 2010

(65) Prior Publication Data

US 2012/0064809 A1 Mar. 15, 2012

Related U.S. Application Data

(60) Provisional application No. 61/177,917, filed on May 13, 2009.

(51) Int. Cl.

| | |
|---|---|
| ***B24D 11/00*** | (2006.01) |
| ***B24D 13/14*** | (2006.01) |
| ***B24D 13/20*** | (2006.01) |

(52) U.S. Cl.

CPC ..... *B24D 13/14* (2013.01); *B24D 13/20* (2013.01)

(58) Field of Classification Search

CPC ..... B24D 13/20; B24D 13/147; B24D 13/14; B24D 9/08; B24B 45/006; B24B 23/022; A47L 11/4038

USPC ..... 15/230, 230.19; 451/526

See application file for complete search history.

(56) References Cited

U.S. PATENT DOCUMENTS 1,998,244 A * 4/1935 Lang ..... 15/230.19
2,100,340 A * 11/1937 Lippitt ..... 15/230

(Continued)

FOREIGN PATENT DOCUMENTS

| | | |
|---|---|---|
| GB | 656202 | 6/1947 |
| RU | 2157752 C2 | 10/2000 |
| RU | 23269 U1 | 6/2002 |

OTHER PUBLICATIONS

PCT International Search Report for PCT/US2010/034627, mailed Sep. 22, 2010.

(Continued)

*Primary Examiner* — Joseph J Hail
*Assistant Examiner* — Marc Carlson
(74) *Attorney, Agent, or Firm* — Aleksander Medved

(57) ABSTRACT

A buffing pad is comprised of a hub with a central opening for attaching the same to a power buffer. The pad includes a layer of tufted wool or other fibrous buffing medium spaced from but surrounding the hub and a block of material such as a cylindrical block of foam positioned between the fibrous buffing medium and the hub. The block of material includes an aperture therethrough that is in alignment with the central opening in the hub. The dimensions of the block of material are such as to prevent tufts of the fibrous buffing medium from entering the central opening of the hub and interfering with the ability of the buffing pad to be attached to the power buffer.

5 Claims, 5 Drawing Sheets

(56) References Cited

U.S. PATENT DOCUMENTS

| | | | | | |
|---|---|---|---|---|---|
| 2,263,883 | A | * | 11/1941 | Livermont | 15/230.19 |
| 2,608,035 | A | * | 8/1952 | Tullo | 15/230.1 |
| 2,666,281 | A | * | 1/1954 | Tocci-Guilbert | 451/511 |
| 2,842,902 | A | * | 7/1958 | Miller et al. | 451/469 |
| 3,007,289 | A | * | 11/1961 | Kent et al. | 15/230.18 |
| 3,092,937 | A | * | 6/1963 | Tocci-Guilbert | 451/509 |
| 3,176,438 | A | * | 4/1965 | Churchill | 451/516 |
| 3,252,775 | A | * | 5/1966 | Tocci-Guilbert | 51/296 |
| 3,413,674 | A | * | 12/1968 | Reid | 15/230.12 |
| 3,436,876 | A | * | 4/1969 | Anderson et al. | 451/510 |
| 3,448,476 | A | * | 6/1969 | Zaccone | 15/97.1 |
| 3,561,173 | A | * | 2/1971 | Block | 451/466 |
| 3,717,894 | A | * | 2/1973 | Wakefield | 15/97.1 |
| 3,742,550 | A | * | 7/1973 | Wakefield | 15/230 |
| 3,912,411 | A | * | 10/1975 | Moffat | 403/259 |
| 3,990,124 | A | * | 11/1976 | MacKay et al. | 15/230.12 |
| 4,307,480 | A | * | 12/1981 | Fallen | 15/230.18 |
| 4,504,999 | A | * | 3/1985 | Pedrotte | 15/230.1 |
| 4,580,308 | A | * | 4/1986 | Ashworth | 15/230.18 |
| 4,607,412 | A | * | 8/1986 | Ashworth | 15/230.18 |
| 4,796,321 | A | | 1/1989 | Lee | |
| 5,088,241 | A | * | 2/1992 | Lubbering et al. | 451/449 |
| 5,230,120 | A | * | 7/1993 | Ireson et al. | 15/230.17 |
| 5,249,329 | A | * | 10/1993 | Arnold | 15/230 |
| 5,289,745 | A | | 3/1994 | Beardsley | |
| 5,389,032 | A | * | 2/1995 | Beardsley | 451/359 |
| 5,438,728 | A | * | 8/1995 | Kubes et al. | 15/180 |
| 5,461,750 | A | * | 10/1995 | Kaiser | 15/230 |
| 5,477,580 | A | * | 12/1995 | Buysse | 15/180 |
| D367,743 | S | * | 3/1996 | Krause et al. | D32/35 |
| 5,893,191 | A | * | 4/1999 | Schneider et al. | 15/230.12 |
| 5,964,006 | A | * | 10/1999 | Holmes et al. | 15/180 |
| 6,163,917 | A | | 12/2000 | Bown | |
| 6,349,446 | B1 | * | 2/2002 | Krause et al. | 15/230 |
| 6,626,067 | B1 | | 9/2003 | Iwinski | |
| 6,640,377 | B2 | * | 11/2003 | Krause et al. | 15/230 |
| 6,895,631 | B1 | * | 5/2005 | Krause et al. | 15/230 |
| 7,657,960 | B2 | * | 2/2010 | Umbrell | 15/230.19 |
| 7,716,778 | B2 | | 5/2010 | Meister | |
| 8,302,255 | B2 | | 11/2012 | Lin | |
| 8,607,399 | B2 | * | 12/2013 | Umbrell | 15/230.19 |
| 2002/0092111 | A1 | * | 7/2002 | Krause et al. | 15/230 |
| 2002/0142712 | A1 | * | 10/2002 | Kaiser | 451/442 |
| 2004/0053569 | A1 | * | 3/2004 | Mueller | 451/359 |
| 2005/0085174 | A1 | * | 4/2005 | Yanase | 451/465 |
| 2007/0184763 | A1 | | 8/2007 | Chung | |
| 2007/0248429 | A1 | * | 10/2007 | Jerome et al. | 409/234 |
| 2007/0266514 | A1 | * | 11/2007 | Umbrell | 15/230.19 |
| 2008/0254725 | A1 | * | 10/2008 | Henning et al. | 451/510 |
| 2009/0028643 | A1 | * | 1/2009 | Snyder et al. | 404/112 |
| 2012/0051832 | A1 | * | 3/2012 | Krause et al. | 403/27 |
| 2012/0052780 | A1 | * | 3/2012 | Krause et al. | 451/526 |
| 2014/0245559 | A1 | * | 9/2014 | Pearlstein | 15/322 |

OTHER PUBLICATIONS

The 2000 Edge, "The Edge 2000® Premium Buffing System—Foam," brochure.

The 2000 Edge Premium Buffing System, "go ahead . . . push my Button," brochure.

* cited by examiner

TUFTED BUFFING PAD

CROSS REFERENCE TO RELATED APPLICATIONS

This application is a national stage filing under 35 U.S.C. 371 of PCT/US2010/034627, filed May 13, 2010, which claims priority to U.S. Application No. 61/177,917, filed May 13, 2009, the disclosure of which is incorporated by reference in its/their entirety herein.

BACKGROUND

The present invention is directed to a tufted buffing pad and, more particularly, to a tufted buffing pad that includes means for preventing the tufts of buffing material adjacent the center of the pad from interfering with the mounting of the buffing pad onto a power buffer.

Buffing pads for use in high speed polishing of automobiles and the like may be one-sided or two-sided. A one-sided buffing pad is typically circular and comprises a buffing medium (e.g., foam, wool, etc.) attached to one face of a rigid backing plate which is attached by a central hub to the drive shaft or spindle of a motor for a power buffer. The buffing medium may be permanently attached to the backing plate or releasably attached thereto in order to allow for replacement without disposing of the backing plate. A two-sided buffing pad includes buffing medium attached to each face of a rigid backing plate. The plate includes a hub for releasably attaching the buffing pad to the drive shaft or spindle of the buffing motor. The pad may be attached to the drive shaft or spindle of the motor from either side of the buffing pad, thereby allowing the pad to be reversed after one side has been used.

Typically, such buffing pads include tufts of wool or other natural or synthetic fibers as the buffing medium. It is also known to use a foam material, for example, an open-cell polyurethane foam, as the buffing medium. Tufted pads, particularly those using wool, are, however, preferred by some workers and are considered by some to be superior to foam pads.

SUMMARY OF THE INVENTION

There is provided a buffing pad comprised of a hub with a central opening for attaching the same to a power buffer. The pad includes a layer of tufted wool or other fibrous buffing medium spaced from but surrounding the hub and a block of material (preferably a cylindrical block of foam) positioned between the fibrous buffing medium and the hub. The block of material includes an aperture therethrough that is in alignment with the central opening in the hub. The dimensions of the block of material are such as to prevent tufts of the fibrous buffing medium from entering the central opening of the hub and interfering with the ability of the pad to be attached to the power buffer.

BRIEF DESCRIPTION OF THE DRAWINGS

For the purpose of illustrating the invention, there is shown in the accompanying drawings one form that is presently preferred, it being understood that the invention is not intended to be limited to the precise arrangements and instrumentalities shown.

DETAILED DESCRIPTION

Figure 1:
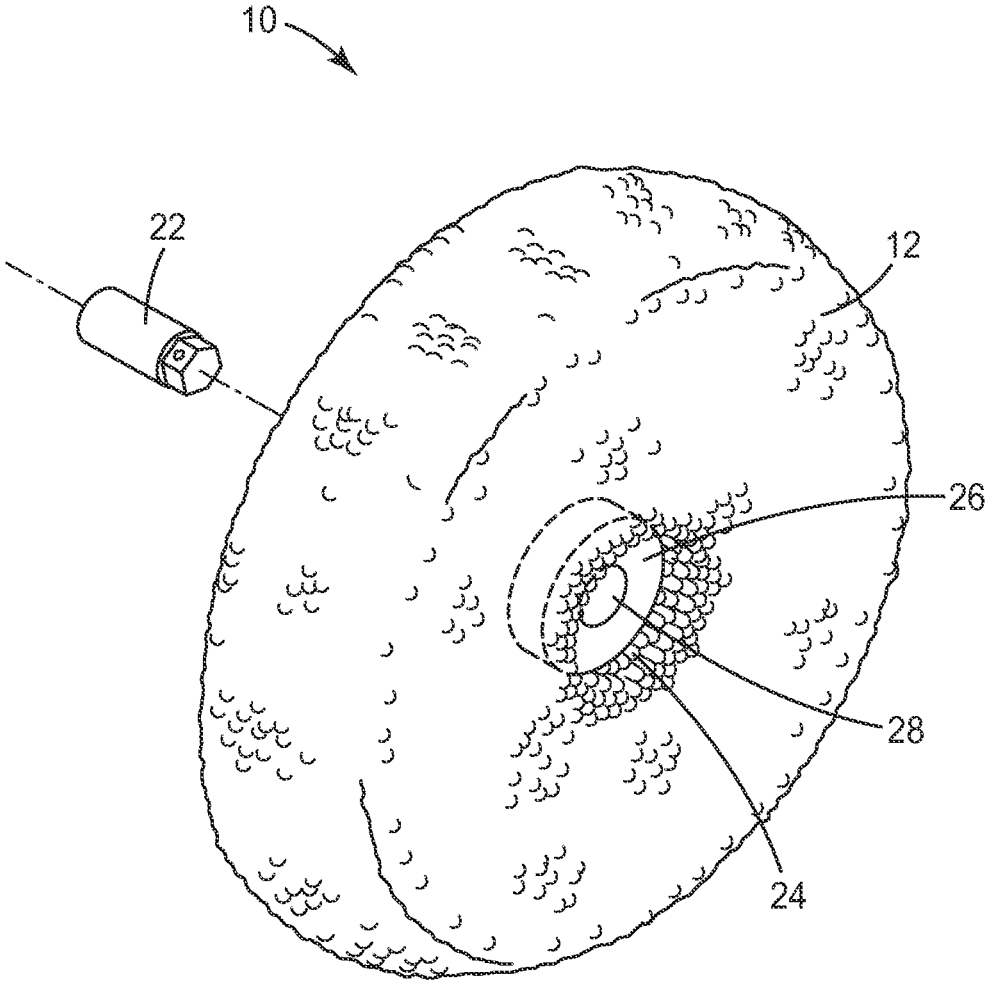
FIG. 1 is a front perspective view of a double-sided buffing pad according to one embodiment of the invention and about to be secured to a connector for attachment to a power buffer.

Referring now to the drawings in detail wherein like reference numerals have been used throughout the various figures to designate like elements, there is show in FIG. 1 one embodiment of a double-sided buffing pad according to the invention and designated generally as 10.

Figure 2:
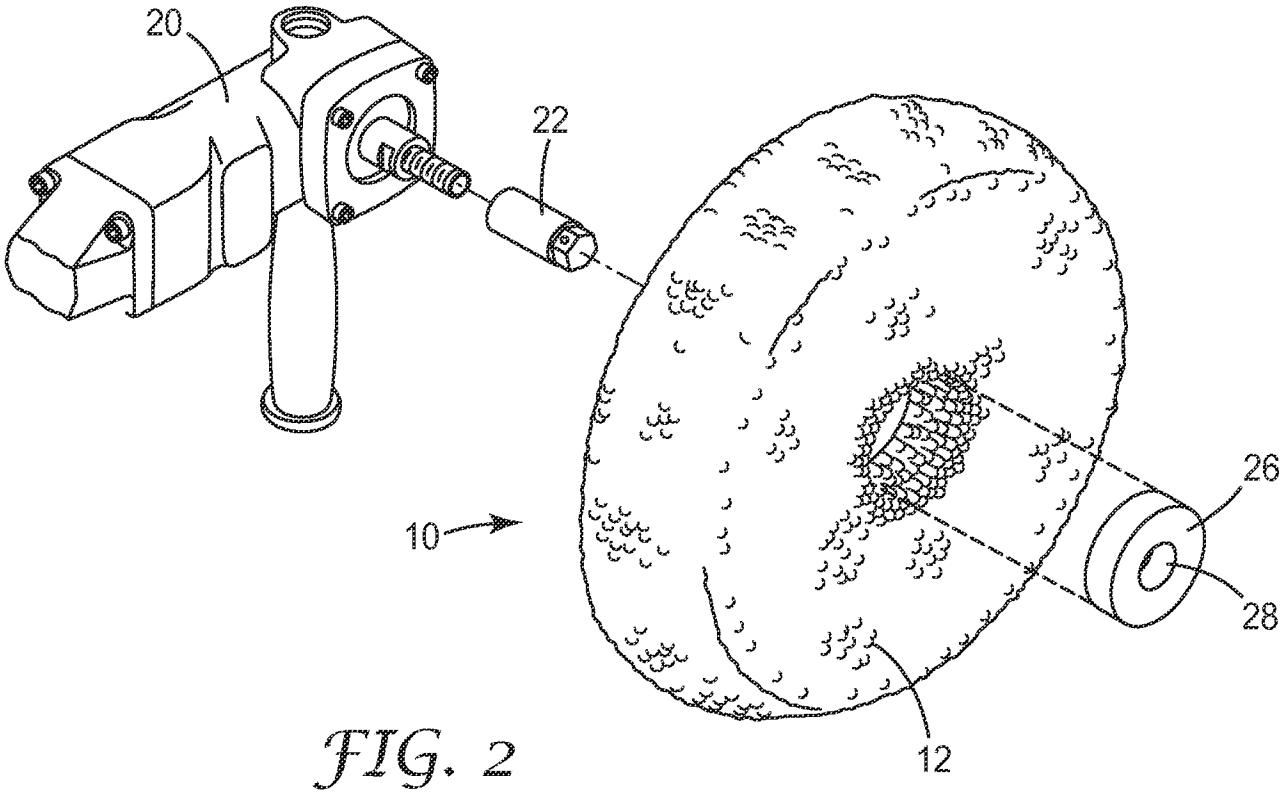
FIG. 2 is a front perspective view similar to FIG. 1 but showing portions of the buffing pad, connector and power buffer partially exploded.
Figure 3:
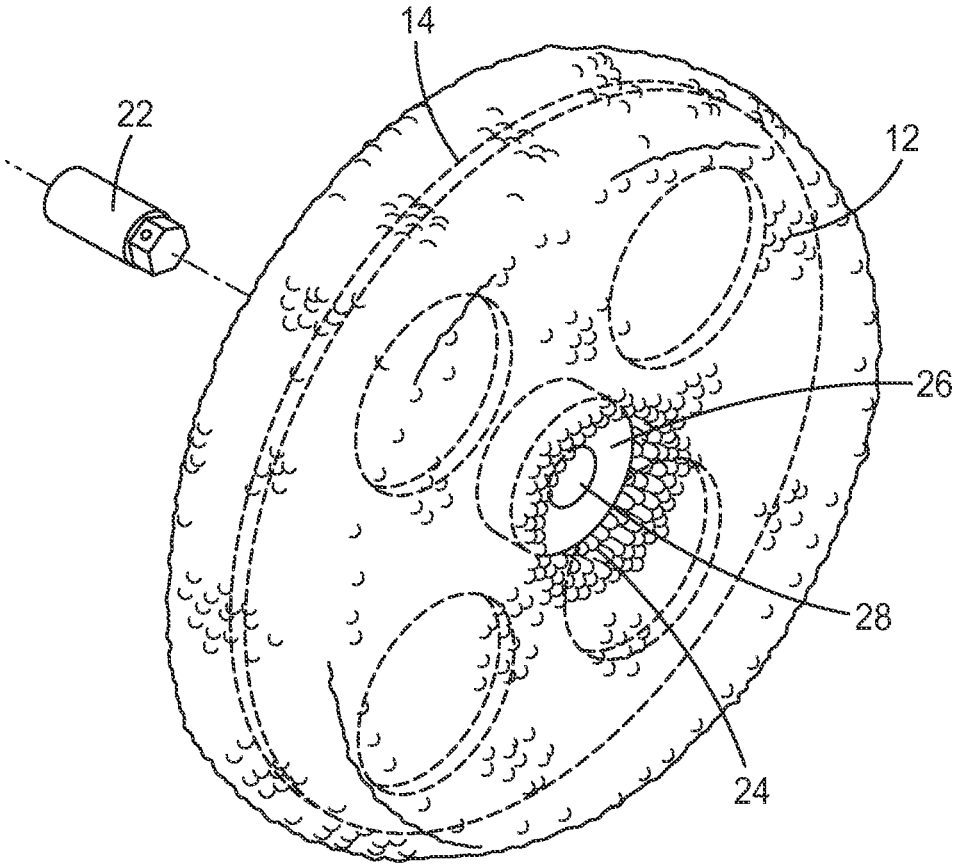
FIG. 3 is also a view similar to FIG. 1 showing the backing plate of the double-sided buffing pad in phantom.
Figure 4:
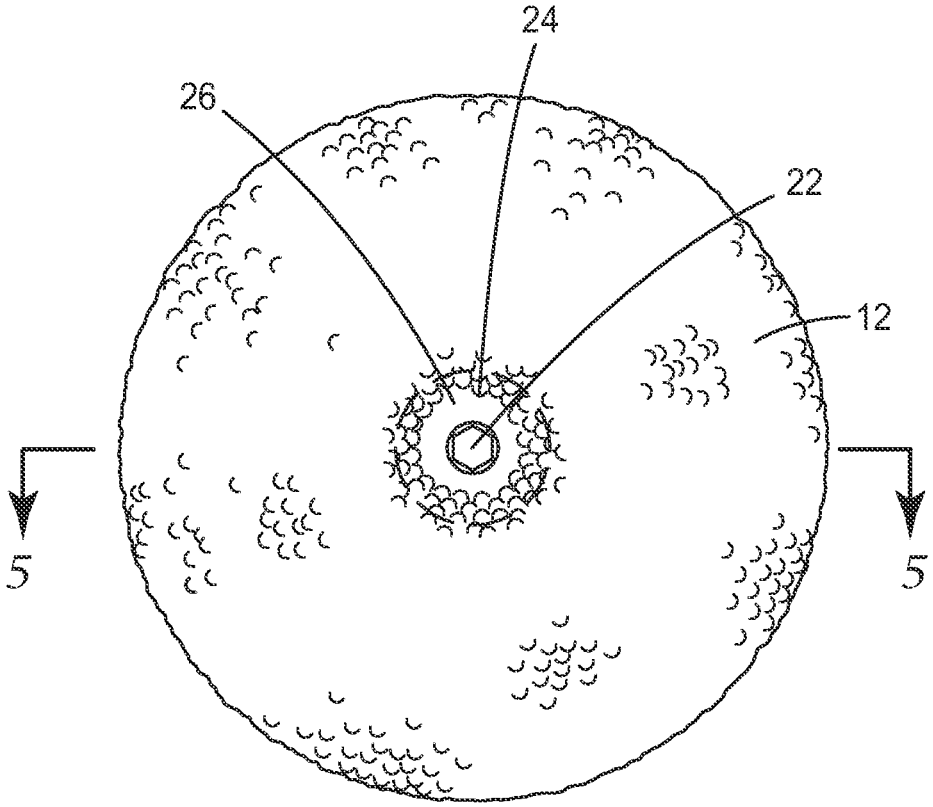
FIG. 4 is a front elevational view of the buffing pad of FIG. 1 with the connector aligned at the center thereof.

The buffing pad 10 is particularly useful for buffing or polishing an automobile and essentially includes a circular layer 12 of tufted wool as the buffing medium. The tufted wool layer 12 is secured to a backing plate 14 as shown in FIG. 3 which includes a central hub 16 having an axial opening 18 for attachment to the drive shaft or spindle of a rotary power buffer 20 through the use of a quick connector 22 (see FIG. 2). The wool layer 12 is comprised of a plurality of tufts or strands of wool 24 that extend outwardly from the inner surface of the layer which is attached to the backing plate 14.

The buffing pad just described is essentially of conventional construction. As is well known in the art, the lengths of the individual tufts of wool 24 making up the layer 12 are substantially equal and have a length sufficient to provide the pad with its ability to buff the surface of an automobile or the like.

After several uses of the buffing pad 10, it frequently occurs that the tufts of wool 24 get matted down and do not extend outwardly as they would in a new pad. While washing or otherwise cleaning the pad may help to revive the strands and raise them from a matted condition, the more frequently that a pad is used, the more likely that the strands or tufts of wool will become matted down and tend to lie flat.

The fact that the strands or tufts of wool 24 become matted down does not normally affect the manner in which the buffing pad 10 is capable of buffing an automobile or other surface. One problem that frequently does occur, however, is that the strands or tufts of wool 24 adjacent the central opening 18 in the hub 16 can over lie the opening or even move into the opening thereby interfering with the ability of the quick connector 22 to enter the opening 18 in the hub 16 to secure the buffing pad to the quick connector. Furthermore, even if one or more strands or tufts of wool 24 enter the opening 18 but still allow the quick connector 22 to be attached, it can sometimes occur that the matted wool strands 24 interfere with the ability to remove the quick connector 22 from the buffing pad.

The foregoing problem is not always caused by tufts of wool 24 that have become matted down. Even with new pads it sometimes occurs that tufts of wool 24 located near the center of the buffing pad 10 will enter the central opening 18 in the hub 16 and interfere with the ability of the quick connector 22 to be attached to or removed from the pad.

This problem can also occur when the hub includes a conventional thread so that it can be threaded onto the drive shaft or spindle of the power buffer.

Thus, there is a need for a buffing pad that includes a means for preventing the tufts of fibrous buffing medium (e.g.

strands of wool) adjacent the center of the pad from interfering with the mounting of the pad onto a power buffer.

Figure 5:
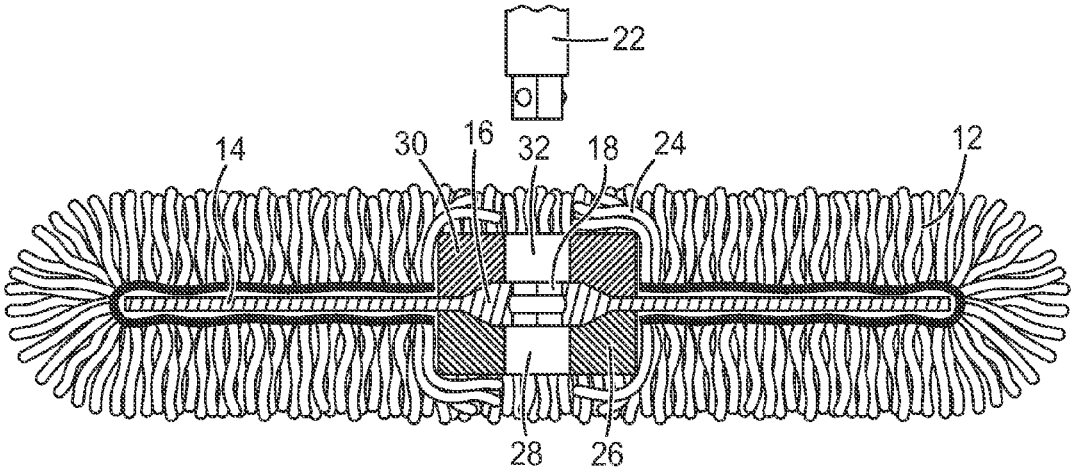
FIG. 5 is a cross-sectional view taken through the line 5-5 of FIG. 4 and showing a connector prior to it being attached to the buffing pad.
Figure 6:
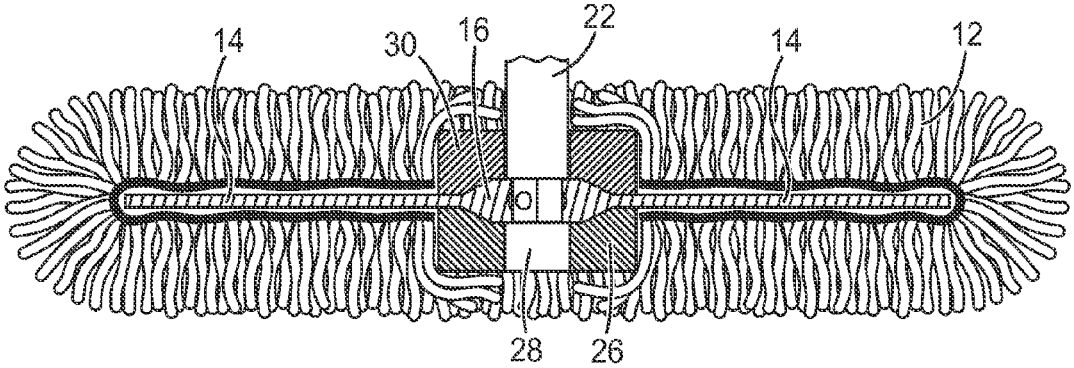
FIG. 6 is a cross-sectional view similar to FIG. 5 but after the connector has been attached to the buffing pad.

The above problem is solved by the use of a block of foam material 26 that is located between the innermost strands or tufts of wool 24 and the opening 18 in the hub 16. As shown most clearly in FIG. 2, the block of foam material 26 is preferably cylindrical in shape and has an aperture 28 in the center thereof which is in alignment with the opening 18 in the hub 16 of the backing plate 14. As shown in FIGS. 5 and 6, a second block of foam material 30 having an opening 32 in the center thereof is located on the opposite side of the pad 10. The two blocks of foam 26 and 30 are typically identical to each other because both sides of a double-sided buffing pad are usually the same.

Each of the blocks of foam material 26 and 30 is secured to the backing plate 14 around the hub 16. This can be done with an adhesive or other suitable attachment. As shown most clearly in FIGS. 5 and 6, the length of the tufts of wool 24 in the vicinity of the blocks of foam material 26 and 30 is not greater than the combined height and wall thickness of the blocks. As a result, even if the strands or tufts of wool 24 become matted, they cannot enter the opening 28 or 32 in the blocks of foam material or the opening 18 in the hub 16 of the backing plate 14. Thus, the tufts 24 are prevented from interfering with the quick connector 22. The blocks should be somewhat resilient and should not abrade or otherwise damage the surface being buffed.

It should be readily apparent to those skilled in the art that the invention is not limited to the use of wool for creating the double sided buffing pad. The invention can be used with buffing media made of substantially any type of fibrous strands or tufted material. This includes natural fiber such as cotton and synthetic fibers.

Similarly, while the invention has been illustrated with a quick connector for attaching the buffing pad to a power buffer, other modes of attachment may be used. For example, axial opening 18 in hub 16 may be threaded for threaded attachment to the drive shaft or spindle of a power buffer. Furthermore, while the blocks 26 and 30 are preferably made from foam, other natural or synthetic materials may be used. For example, the blocks may be made of felt, materials used in washers and gaskets, or the like so long as the blocks are able to prevent the tufts of fibrous buffing media from entering the center opening in the buffing pad while, at the same time, not themselves interfere with the ability to connect the buffing pad to the power buffer.

The present invention may be embodied in other specific forms without departing from the spirit or essential attributes thereof and accordingly, reference should be made to the appended claims rather than to the foregoing specification as indicating the scope of the invention.

What is claimed is:

1. A double-sided buffing pad comprising:

a backing plate comprising a central opening for attaching the same to a drive shaft or spindle of a power buffer;

a layer of fibrous buffing medium positioned along each side of the backing plate with the fibrous buffing medium extending outwardly from the backing plate, the fibrous buffing medium comprising innermost strands proximate the central opening;

a block of material, different from the fibrous buffing medium, on each side of the backing plate positioned between the innermost strands and the central opening and having an aperture therethrough in alignment with the central opening, the block of material preventing the innermost strands from entering the central opening when the drive shaft or spindle of the power buffer is inserted into the central opening wherein the innermost strands would otherwise be permitted to enter the central opening, thereby preventing the innermost strands from interfering with attachment of the buffing pad to a power buffer.

2. The buffing pad of claim 1 wherein at least one block of material is cylindrical in shape.

3. The buffing pad of claim 2 wherein said cylindrical shape has a height and a wall thickness and wherein the strands of fibrous buffing medium in the vicinity of said block have a length that is not greater than the combined height and wall thickness of said block.

4. The buffing pad of claim 1 wherein said fibrous buffing medium is wool.

5. The buffing pad of claim 1 wherein at least one block of material is comprised of foam.

* * * * *